US005390926A

United States Patent [19]

Hanson et al.

[11] Patent Number: 5,390,926

[45] Date of Patent: Feb. 21, 1995

[54] PRACTICE PUTTING GREEN

[75] Inventors: Greg A. Hanson; Todd A. Walchli, both of Maryville, Tenn.

[73] Assignee: GT Sports Marketing, Maryville, Tenn.

[21] Appl. No.: 251,610

[22] Filed: May 31, 1994

[51] Int. Cl.[6] ..... A63B 69/36

[52] U.S. Cl. ..... 273/178 B; 273/176 E; 273/176 H

[58] Field of Search ..... 273/178 R, 34 R, 176 R, 273/176 E, 176 H, 195 B, 178 R

[56] References Cited

U.S. PATENT DOCUMENTS

| | | | |
|---|---|---|---|
| D. 273,126 | 3/1984 | Turza et al. | D21/234 |
| 1,612,292 | 12/1926 | Jackson | 273/178 B |
| 1,679,374 | 8/1928 | Reirden | 273/178 B |
| 2,716,029 | 8/1955 | Montgomery | 273/178 R |
| 3,604,710 | 9/1971 | Jacobs | 273/176 E |
| 3,690,673 | 9/1972 | Occhipinti | 273/176 H |
| 3,735,988 | 5/1973 | Palmer et al. | 273/178 B |
| 3,871,650 | 3/1975 | Casey | 273/178 BX |
| 3,885,795 | 5/1975 | Brewer | 273/176 E |
| 3,892,412 | 7/1975 | Koo | 273/176 H |
| 5,007,644 | 4/1991 | Bluthardt et al. | 273/178 B |
| 5,069,455 | 12/1991 | Thomas | 273/176 H |
| 5,082,280 | 1/1992 | Wang | 273/179 C |
| 5,100,145 | 3/1992 | Kim | 273/176 H |
| 5,131,658 | 7/1992 | Grenon | 273/180 |
| 5,139,262 | 8/1992 | Lai | 273/179 C |

*Primary Examiner*—William H. Grieb
*Attorney, Agent, or Firm*—Pitts & Brittian

[57] ABSTRACT

A practice putting green for simulating an actual golf green and for practicing golf putts. The practice putting green includes a putting mat, which defines a putting surface with a texture similar to that of an actual golf green and is of a sufficient size to accommodate putting practice. A plurality of contour gradient pads are provided and are selectively placed under the putting mat to define a desired contour. A putting cup is positioned proximate an opening in the putting mat and receives the golf ball when the ball is putted properly. A perimeter putting mat is aligned with the putting mat and provides a location from which the ball is putted.

15 Claims, 6 Drawing Sheets

PRACTICE PUTTING GREEN

TECHNICAL FIELD

This invention relates to the field of putting greens and in particular a fabricated putting green having a distortable playing surface.

BACKGROUND ART

The use of practice putting devices has become an increasingly popular means for a golfer to practice his putting away from the golf course. Learning to control the ball when putting is extremely difficult. Each green on a golf course is typically configured to challenge the golfer. When using a practice putting device it is desirable that the device simulate a golf course putting green as closely as possible. For example, the texture of the practice putting surface should be similar to that of a typical putting green. Further, the practice putting device should have a topography which provides a variety of challenging putts.

Several devices have been produced which teach golf putting practice devices. Typical of the art are those devices disclosed in U.S. Pat. Nos. 5,007,644 issued to Bluthardt et al. on Apr. 16, 1991; 5,069,455 issued to W. F. Thomas on Dec. 3, 1991; 5,082,280 issued to A. Wang on Jan. 21, 1992; 5,100,145 issued to S. Kim on Mar. 31, 1992 and 5,139,262 issued on Aug. 18, 1992.

U.S. Pat. No. 5,007,644 discloses a golf putting practice target which is a one piece molded device. The topography can not be altered. Once the golfer has successfully learned to control the golf ball for this particular device the device is rendered useless. Further, the device is not easily stored.

U.S. Pat. No. 5,069,455 discloses a golf putting trainer in which the surface topography can be changed via elevation adjustment assemblies which are located along the perimeter of the putting surface. The topography can be changed to a certain extent but the user does not have control over the center portion of the putting surface. Again, the device is not easily stored when not in use.

U.S. Pat. Nos. 5,082,280 and 5,139,262 disclose putting practice devices which are permanently sloped and provide a means for returning the ball when it is sunk in the hole. The '280 patent teaches a device in which only a central portion of the putting surface can be altered such the golfer is limited in the amount of different configurations with which he can practice. The '262 does not provide a means for altering the topography but does provide a means for rotating the surface mat such that an uphill or a downhill putt can be practiced. With either device, the golfer is limited in the variety of putts he can practice. Again, the devices are not easily stored when not in use.

U.S. Pat. No. 5,100,145 discloses a putting green with an adjustable topography. The topography is adjusted either by releasing or tightening strings to release pull up the sides of the device or by prepositioned actuators under the putting surface. In either embodiment, the golfer will be limited in the variety of putts he can practice. Further, the actuators impart an unrealistic topography to the putting surface. The device is not easily stored when not in use.

Therefore, it is an object of this invention to provide a practice putting green in which the topography is distortable in a manner such that an actual putting green can be realistically simulated.

It is another object of present invention to provide a practice putting green which provides a putting surface which simulates the putting surface of a golf course.

Further, it is an object of present invention to provide a practice putting green which is easily stored.

DISCLOSURE OF THE INVENTION

Other objects and advantages will be accomplished by the present invention which teaches a practice putting green which simulates in texture and topography an actual putting green. The practice putting green of the present invention includes a putting mat, which is flexible and defines a putting surface of a sufficient size to accommodate putting practice, and a plurality of contour gradient pads, which are selectively placed under the putting mat, perimeter mat or directly under the putting cup, to define a desired contour. The putting mat defines an opening for receiving a golf ball which is putted properly.

BRIEF DESCRIPTION OF THE DRAWINGS

The above mentioned features of the invention will become more clearly understood from the following detailed description of the invention read together with the drawings in which.

BEST MODE FOR CARRYING OUT THE INVENTION

Figure 1:
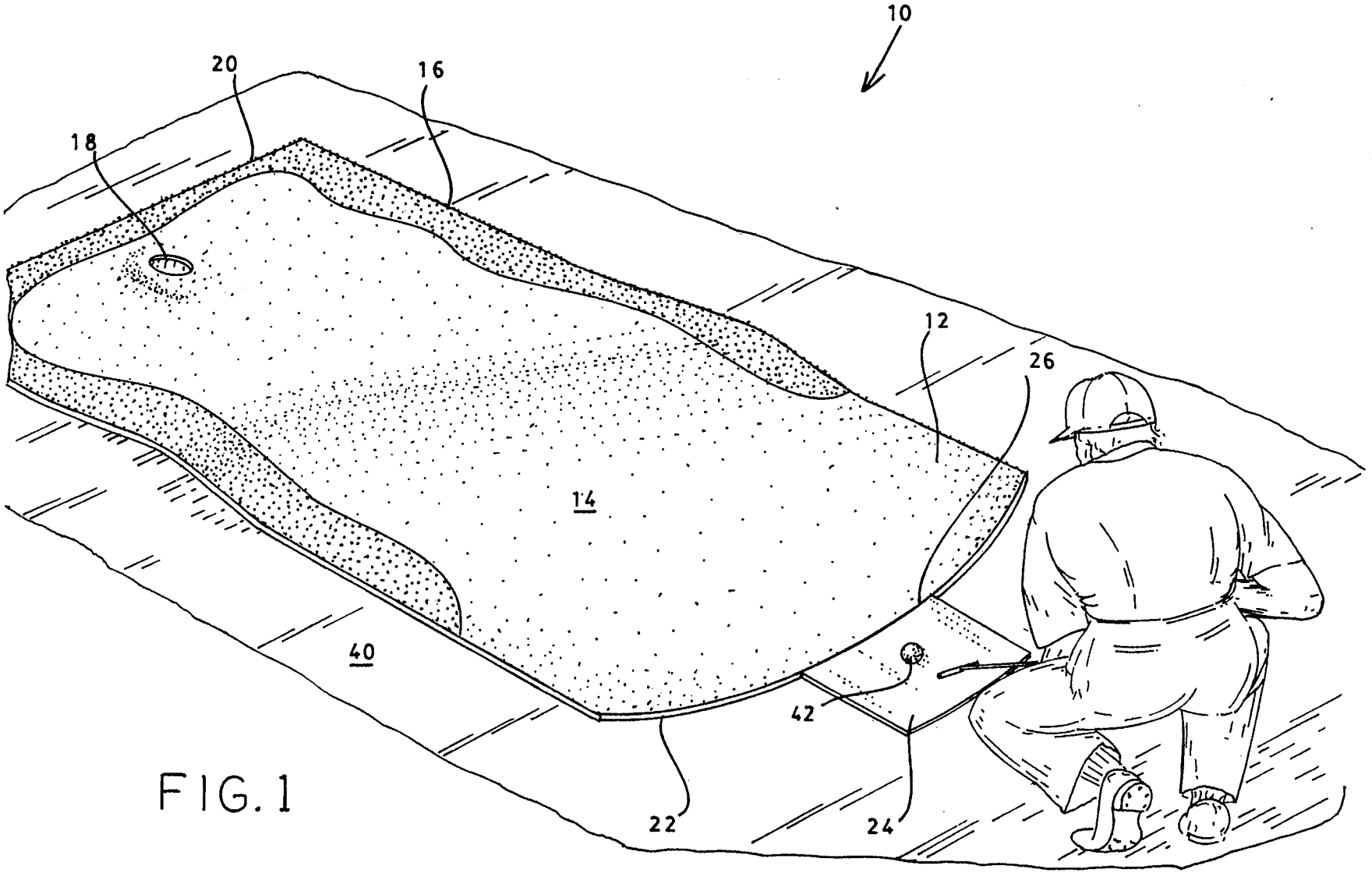
FIG. 1 is a perspective view of the practice putting green constructed in accordance with several features of the present invention.

A practice putting green incorporating various features of the present invention is illustrated generally at 10 in the figures. The practice putting green 10 is designed to provide a putting mat which simulates, in topography and texture, an actual putting green. Moreover, in the preferred embodiment the practice putting green 10 is designed to be easily stored when not in use.

As shown in the Figures, the practice putting green 10 generally includes a putting mat 12, which is of a sufficient size to accommodate putting practice, a perimeter putting mat 24, which can be aligned with the putting mat 12 and upon which a golf ball 42 is placed and from which the ball 42 is putted, a plurality of contour gradient pads 30, which are selectively placed under the putting mat 12 to define a desired contour, and a putting cup 32 which receives the golf ball 42 when the ball 42 is putted properly.

The putting mat 12 defines a putting surface 14 which is fabricated to resemble the texture of an actual green of a golf course. More specifically, the putting mat 12 is fabricated such that the speed or "stimp" of the putting surface 14 resembles that of a typical green. The putting mat 12 is fabricated from a flexible material. Further, it is preferable that the putting mat 12 be fabricated from a material which does not deform when rolled up. In this manner, the putting mat 12 can be rolled up for storage and will not display any unwanted undulations and contours when it is rolled out for use. In the preferred embodiment, the putting mat 12 is fabricated from a Fern Green HUV 18K05, 18 ounce velour with All Weather Marine BACK as the backing material. The material for the putting surface 14 is a nonwoven material which provides the desired textured surface. It is backed with a material which is flexible for rolling up yet does not retain the rolled shape when unrolled.

Preferably, the putting mat 12 includes a simulated rough 16 and an opening 18. The simulated rough 16 is situated around the perimeter of three sides of the putting mat 12. The simulated rough 16 is a higher friction material, i.e. a slower speed than that of the putting surface 14. The simulated rough 16 of the putting mat 12 imitates the rough around a typical putting green such that the appearance of a typical putting green are simulated. The simulated rough 16 is higher or taller than the putting surface 14 and is adhered to the fiber on the putting surface 14. The simulated rough 16 is fabricated from a nylon product. The process by which the simulated rough 16 is adhered to the putting surface 14 is flocking. Flocking is the use of glue and heat to permanently bond the simulated rough 16 material to the putting surface 14.

The putting mat 12 also includes an opening 18 proximate a distal end 20 of the putting mat 12 for receiving the golf ball 42 when it is aimed and putted properly.

The perimeter putting mat 24 is configured to abut a proximal end 22 of the putting mat 12. The location of the perimeter putting mat 24 is adjustable and can be moved along the end 22 of the putting mat 12, as shown most clearly in FIG. 2. In this way, the golf putt is changed simply by moving the perimeter putting mat 24 to a different location. It is preferable that the ball 42 is placed on the perimeter putting mat 24 and putted therefrom. In this manner, the golfer does not have to stand directly on the putting mat 12 thereby creating unwanted undulations or wear in the putting mat 12. The perimeter putting mat 24 is fabricated from the same material as the putting surface 14 and is of the same thickness such that when the perimeter putting mat 24 is mated with the putting mat 12 there is no significant gap or ridge to affect the direction of the ball 42.

Figure 2:
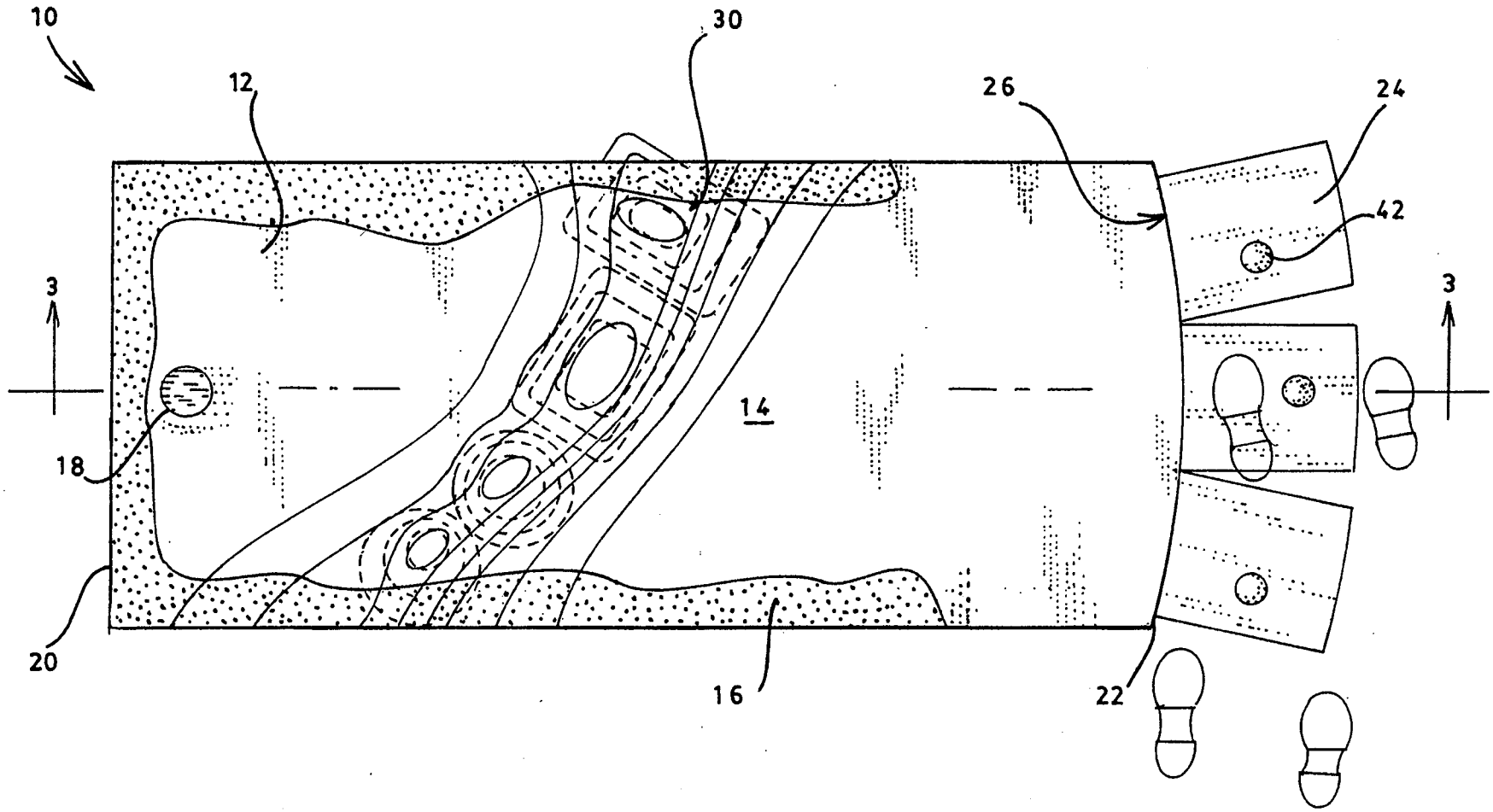
FIG. 2 illustrates a plan elevation view of the practice putting green showing a plurality of contour gradient pads in phantom.

The putting mat 12 defines a configuration at the proximal end 22 which mates with the configuration of the perimeter putting mat 24. Most preferably, the configuration of the end 22 of the putting mat 12 is rounded, as shown in FIGS. 1 and 2. Further, the mating end 26 of the perimeter putting mat 24 is rounded to receive and abut with the end 22 of the putting mat 12.

Figure 8:
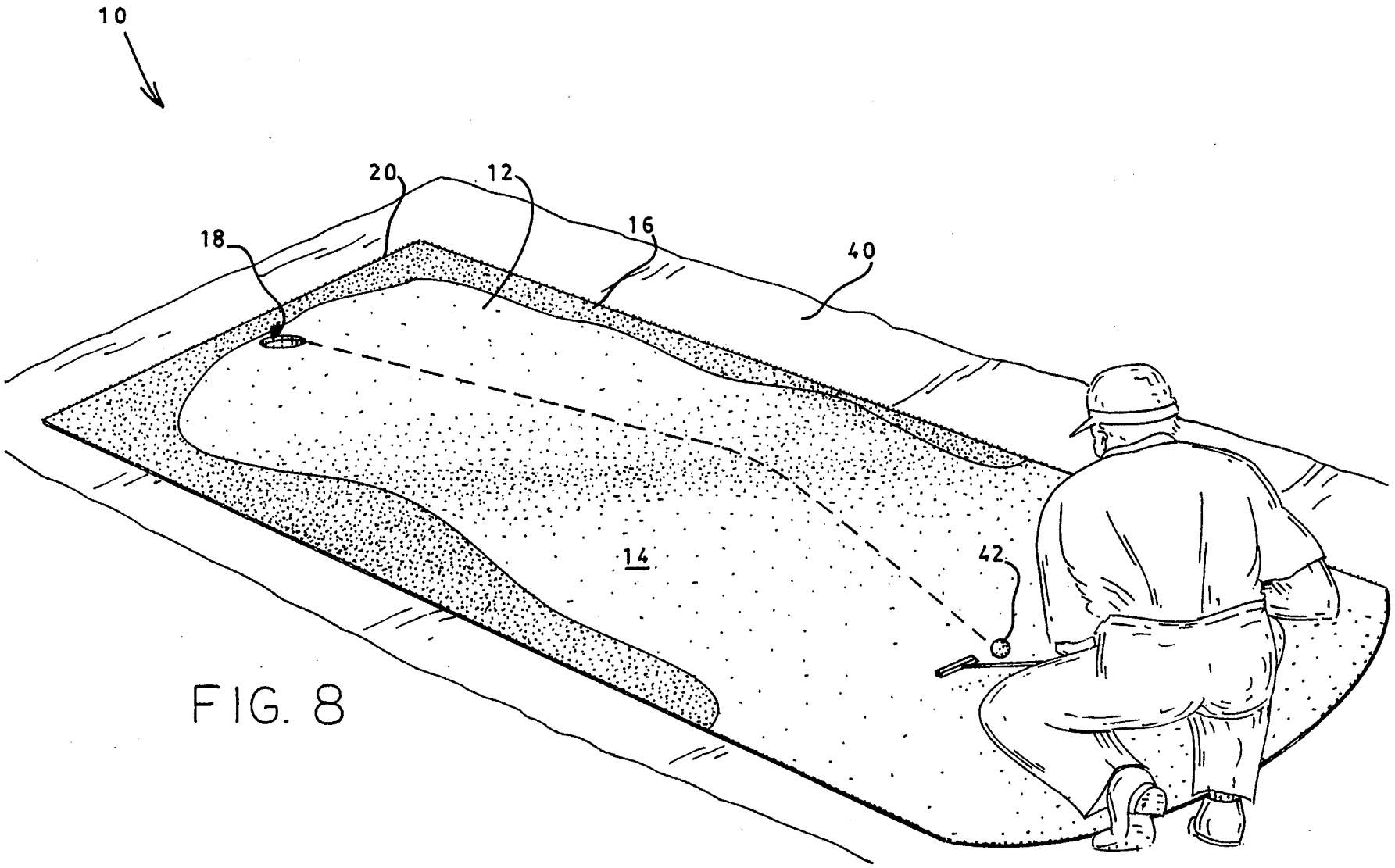
FIG. 8 is a perspective view of the practice putting green.

It will be noted that if the putting mat is placed on a hard level surface the possibility of creating unwanted undulations is greatly reduced. In this case, the perimeter putting pad does not have to be used and shorter putts may be practiced, as shown in FIG. 8.

In the preferred embodiment, the perimeter putting mat has a rounded edge on opposite sides and straight edges on the remaining two sides, as shown in the Figures. In this manner, the maximum use of the material from which the perimeter putting mat 24 is cut is utilized.

In an alternate embodiment, the perimeter putting mat 24 can be utilized as a chipping mat. In this case the perimeter putting mat 24 would have to be thicker such that it could absorb the dig of a golf club. When used as a chipping mat, it would be pulled a distance away from the putting mat such that chip shots could be practiced. Further, a padding can be placed under the putting mat such that the chipped ball can dig or grip the surface to simulate more accurately the reaction of a ball that has been chipped onto an actual putting green.

Figure 3:
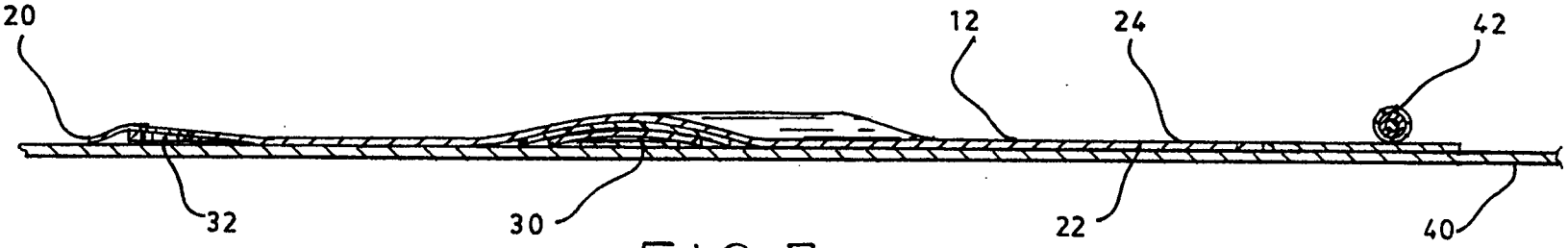
FIG. 3 is a side elevation view, in section, taken along line 3—3 of FIG. 2.
Figure 5:
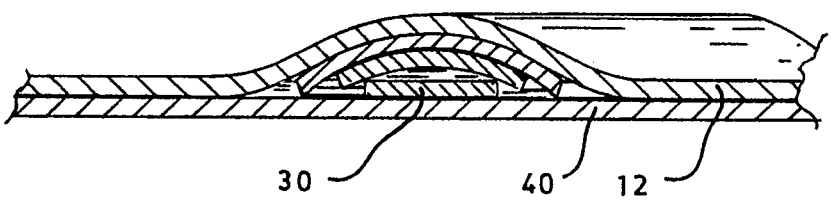
FIG. 5 is a side elevation view, in section, of a plurality of contour gradient pads situated under the putting mat.
Figure 4:
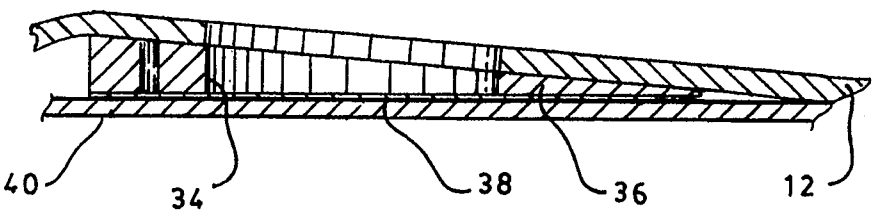
FIG. 4 is a side elevation view, in section, of the putting cup.
Figure 7:
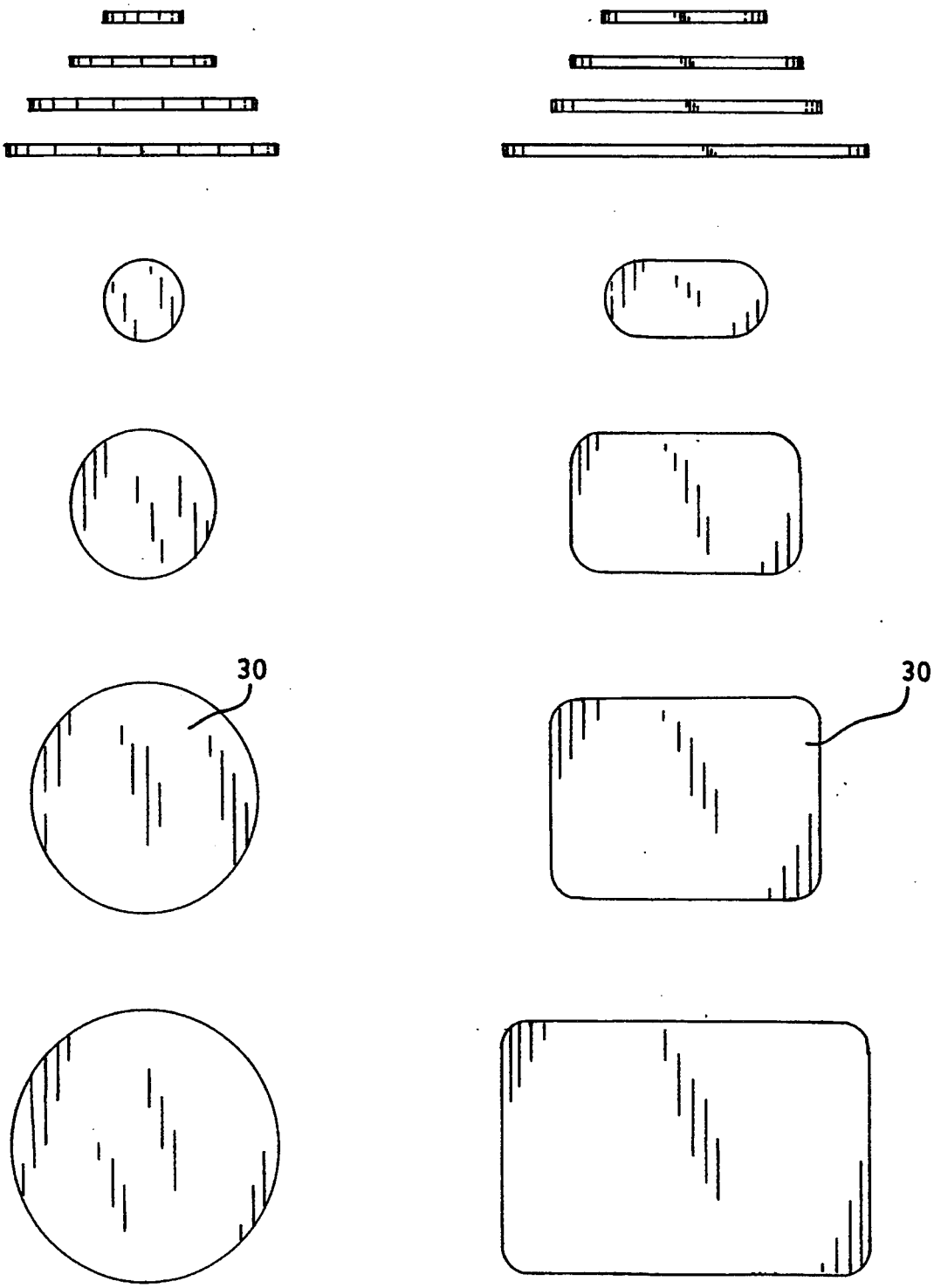
FIG. 7 illustrates side and plan views of a plurality of contour gradient pads.

FIGS. 2, 3 and 5 most clearly show undulations or contours imparted to the putting mat 12. The undulations are created by placing one or more contour gradient pads 30 under the putting mat 12. A variety of configurations and sizes of contour gradient pads 30 are shown in FIG. 7. The configuration of the contour gradient pads is not limited to those shown in FIG. 7. For example, the contour gradient pads 30 can be configured in a kidney shape, a curved shape, a triangular shape, etc. The contour gradient pads 30 are fabricated from a flexible material and, in the preferred embodiment, the contour gradient pads 30 are fabricated from an expanded vinyl such as SOFT FOOT TM. The contour gradient pads 30 are preferably approximately $\frac{1}{8}$" thick. If the contour gradient pads 30 are too thick, ridges would result when the putting mat 12 is placed over the contour gradient pad 30 affecting the normal or desired traverse of a putted golf ball.

In the preferred embodiment, a putting cup 32 is placed under the opening 18 defined by the putting mat 12 to receive the golf ball 42 when it is struck properly. The putting cup 32 used in the preferred embodiment is a regulation size golf putting cup such as the golf putting target taught in U.S. Pat. Des. No. 273,126. The putting cup 32 is sloped or wedge-shaped such that the ball 42 is received at the narrow end 36 and its motion is stopped when it hits the back wall 34 of the putting cup 32. The putting cup 32 has a backing 38 secured to its bottom such that when a golf ball 42 falls into the putting cup 32, a sound similar to a ball 42 hitting the bottom of an actual putting cup is simulated. Further, the backing 38 permits the placement of contour gradient pads 30 directly under the cup 32 such that the cup 32 can be tilted in any direction or risen to any height desired, thus, allowing the golfer to further change the parameters of the putting theme. In the preferred embodiment, 40 mil polystyrene is secured to the bottom of the putting cup 32.

To use the practice putting green 10, the putting mat 12 is laid out on a level support surface 40 such that there are not any unwanted hills or slopes. The putting cup 32 is placed under the putting mat 12 at the opening 18 defined by the putting mat 12. The putting cup 32 is situated such that the golf ball 42 is received by the cup 32 at the narrow end 36.

Figure 6:
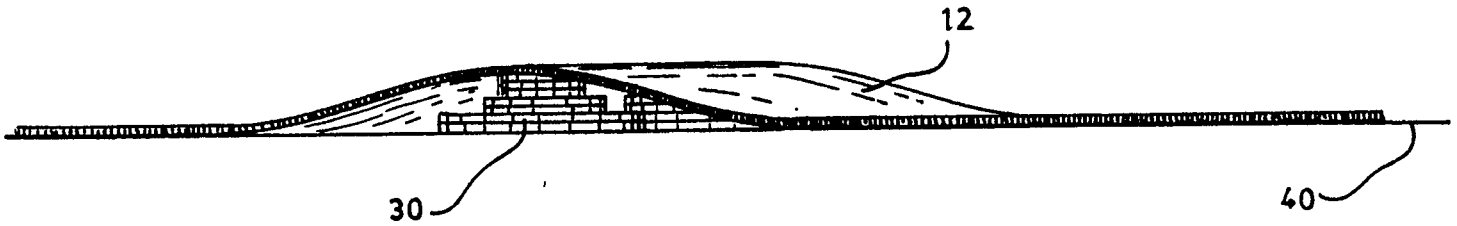
FIG. 6 is a side elevation view, in section, of a plurality of contour gradient pads situated under the putting mat.

To create a desired profile, the contour gradient pads 30 are set out individually or are stacked depending upon the contour of the putting mat 12 desired. Any combination can be mixed or matched utilizing any shape or size contour gradient pad 30 to achieve the desired putting profile. When higher undulations are desired, it is preferable, but not necessary, to layer larger contour gradient pads 30 on top of smaller contour gradient pads 30, as shown in FIG. 5. When layered in this manner, the putting mat 12 will not show ridges or bumps which will dramatically affect the roll of the ball 42. FIG. 6 illustrates a layering of the contour gradient pads wherein the smaller pads are placed on top of larger pads to define a desired contour. Once the contour gradient pads 30 are laid as desired they are placed under the putting mat 12. The perimeter putting mat 24 is mated to the corresponding end 22 of the putting mat 12 at a selected location. A golf ball 42 is placed on the perimeter putting mat 24. The golfer stands on either side of the perimeter putting mat 24, depending upon whether he is left-handed or right-handed, and aims and putts the ball 42. Once the particular shot is perfected or the golfer wants a change, he can simply adjust the location of the perimeter putting mat 24 to change the shot. Further, the golfer can alter the undulations or contour of the putting mat 12 by removing or adding contour gradient pads 30 as the golfer sees fit. The number of contours 30 that can be imparted to the putting mat 12 are limitless.

Because of the flexibility of the components of the practice putting green 10, it is easily rolled up. In the preferred embodiment, the practice putting green 10 is rolled up and stored in its original packing box (not shown) when it is not being used. When stored as packaged, the practice putting green 10 can be easily and quickly stored away.

From the foregoing description, it will be recognized by those skilled in the art that a practice putting green offering advantages over the prior art has been provided. Specifically, the practice putting green provides a putting mat which simulates an actual putting green in texture. Further, the contour gradient pads provide a means for simulating contours or undulations in the putting surface thereby simulating the contours of an actual putting green. Moreover, the practice putting green is easily stored when not in use.

While a preferred embodiment has been shown and described, it will be understood that it is not intended to limit the disclosure, but rather it is intended to cover all modifications and alternate methods falling within the spirit and the scope of the invention as defined in the appended claims.

Having thus described the aforementioned invention, I claim:

1. A practice putting green for practicing golf putts, said practice putting green comprising:

a putting mat defining a putting surface and an opening, said putting surface defining a selected texture to simulate actual putting conditions, said opening being disposed proximate a distal end of said putting surface to simulate the opening of a conventional golf cup, said putting mat being fabricated from a flexible material; and a plurality of contour gradient pads for being selectively positioned under said putting mat such that a selected contour is defined, said plurality of contour gradient pads defining at least one configuration, each of said plurality of contour gradient pads being fabricated from a flexible material, said plurality of contour gradient pads being positionable at least a portion of one over another.

2. The practice putting green of claim 1 which further includes a perimeter putting mat for abutting to a proximal end of said putting mat, said perimeter putting mat providing a location for an initial placement of a golf ball and from which the golf ball is putted, said perimeter putting mat being fabricated from said flexible material of said putting mat.

3. The practice putting green of claim 1 which further includes a putting cup for receiving a golf ball, said putting cup being positioned under said putting mat proximate said opening.

4. The practice putting green of claim 3 wherein said putting cup defines a bottom wall for receiving a golf ball, said bottom wall being fabricated from a rigid material.

5. The practice putting green of claim 1 wherein said putting mat further includes a simulated rough disposed around a portion of a perimeter of said putting mat proximate said opening, said simulated rough for simulating a rough around an actual putting green.

6. The practice putting green of claim 1 wherein said plurality of contour gradient pads defines a plurality of sizes and configurations.

7. A practice putting green for practicing golf putts, said practice putting green comprising:

a putting mat defining a putting surface and an opening, said putting surface defining a selected texture to simulate actual putting conditions, said opening being disposed proximate a distal end of said putting surface to simulate the opening of a conventional golf cup, said putting mat being fabricated from a flexible material;

a plurality of contour gradient pads for being selectively positioned under said putting mat such that a selected contour is defined, said plurality of contour gradient pads defining at least one configuration, each of said plurality of contour gradient pads being fabricated from a flexible material, said plurality of contour gradient pads being positionable at least a portion of one over another; and a perimeter putting mat for abutting to a proximal end of said putting mat, said perimeter putting mat providing a location for an initial placement of a golf ball and from which the golf ball is putted, said perimeter putting mat being fabricated from said flexible material of said putting mat.

8. The practice putting green of claim 7 which further includes a putting cup for receiving a golf ball, said putting cup being positioned under said putting mat proximate said opening.

9. The practice putting green of claim 8 wherein said putting cup defines a bottom wall for receiving a golf ball, said bottom wall being fabricated from a rigid material.

10. The practice putting green of claim 7 wherein said putting mat further includes a simulated rough disposed around a portion of a perimeter of said putting mat proximate said opening, said simulated rough for simulating a rough around an actual putting green.

11. The practice putting green of claim 7 wherein said plurality of contour gradient pads defines a plurality of sizes and configurations.

12. A practice putting green for practicing golf putts, said practice putting green comprising:

a putting mat defining a putting surface and an opening, said putting surface defining a selected texture to simulate actual putting conditions, said opening being disposed proximate a distal end of said putting surface to simulate the opening of a conventional golf cup, said putting mat being fabricated from a flexible material;

a plurality of contour gradient pads for being selectively positioned under said putting mat such that a selected contour is defined, said plurality of contour gradient pads defining at least one configuration, each of said plurality of contour gradient pads being fabricated from a flexible material, said plurality of contour gradient pads being positionable at least a portion of one over another;

a perimeter putting mat for abutting to a proximal end of said putting mat, said perimeter putting mat providing a location for an initial placement of a golf ball and from which the golf ball is putted, said perimeter putting mat being fabricated from said flexible material of said putting mat; and a putting cup for receiving a golf ball, said putting cup being positioned under said putting mat proximate said opening.

13. The practice putting green of claim 12 wherein said putting cup defines a bottom wall for receiving a golf ball, said bottom wall being fabricated from a rigid material.

14. The practice putting green of claim 12 wherein said putting mat further includes a simulated rough disposed around a portion of a perimeter of said putting mat proximate said opening, said simulated rough for simulating a rough around an actual putting green.

15. The practice putting green of claim 12 wherein said plurality of contour gradient pads defines a plurality of sizes and configurations.

* * * * *